US007891910B2

(12) United States Patent
Schakenda et al.

(10) Patent No.: US 7,891,910 B2
(45) Date of Patent: Feb. 22, 2011

(54) FOUNDATION STRUCTURE

(75) Inventors: Bruno Schakenda, Frederikshavn (DK); Søren Andreas Nielsen, Fjerritslev (DK); Lars Bo Ibsen, Aalborg (DK)

(73) Assignee: MBD Offshore Power A/S, Frederikshavn (DK)

( * ) Notice: Subject to any disclaimer, the term of this patent is extended or adjusted under 35 U.S.C. 154(b) by 0 days.

(21) Appl. No.: 12/226,255

(22) PCT Filed: Apr. 10, 2007

(86) PCT No.: PCT/DK2007/000178

§ 371 (c)(1),
(2), (4) Date: Nov. 4, 2008

(87) PCT Pub. No.: WO2007/115573

PCT Pub. Date: Oct. 18, 2007

(65) Prior Publication Data

US 2009/0191004 A1 Jul. 30, 2009

(30) Foreign Application Priority Data

Apr. 10, 2006 (DK) ..... 2006 00520

(51) Int. Cl.
*E02D 5/32* (2006.01)

(52) U.S. Cl. ..... 405/224.1; 405/226

(58) Field of Classification Search ..... 405/224, 405/224.1, 226

See application file for complete search history.

(56) References Cited

U.S. PATENT DOCUMENTS 4,036,161 A * 7/1977 Nixon ..... 405/226
4,063,426 A * 12/1977 Hansen ..... 405/226
4,106,302 A * 8/1978 Vogel ..... 405/226
4,109,477 A * 8/1978 Vogel ..... 405/226

(Continued)

FOREIGN PATENT DOCUMENTS

GB 2277547 11/1994

(Continued)

OTHER PUBLICATIONS

Houlsby et al.; "Suction caissons for wind turbines"; Frontiers in Offshore Geotechnics—Gourvenec & Cassidy (eds); 2005 Taylor & Francis Group, London; ISBN 0 415 39063X; pp. 75-93.

*Primary Examiner*—Frederick L Lagman
(74) *Attorney, Agent, or Firm*—James Creighton Wray

(57) ABSTRACT

Method of installing a bucket foundation structure comprising one, two, three or more skirts, into soils in a controlled manner. The method comprises two stages: a first stage being a design phase and the second stage being an installation phase. In the first stage, design parameters are determined relating to the loads on the finished foundation structure; soil profile on the location of installation; allowable installation tolerances, which parameters are used to estimate the minimum diameter and length of the skirts of the bucket. The bucket size is used to simulate load situations and penetration into foundation soil, in order to predict necessary penetration force, required suction inside the bucket and critical suction pressures, which penetration force, required suction, and critical suction pressures are used as input for a control system in the second stage, in which second stage the pa-rameters determined in the first stage are used in order to control the installation of the bucket.

8 Claims, 9 Drawing Sheets

The foundation structure

U.S. PATENT DOCUMENTS

| | | | | |
|---|---|---|---|---|
| 4,761,096 | A * | 8/1988 | Lin | 405/224.1 |
| 6,481,932 | B1 * | 11/2002 | Riemers | 405/224.1 |
| 6,488,446 | B1 * | 12/2002 | Riemers | 405/224.1 |
| 7,407,342 | B2 * | 8/2008 | Seidel | 405/224.1 |

FOREIGN PATENT DOCUMENTS

| | | |
|---|---|---|
| GB | 2336384 | 10/1999 |
| WO | WO 94/06970 | 3/1994 |
| WO | WO 01/71105 | 9/2001 |
| WO | WO 2005/038146 | 4/2005 |

* cited by examiner

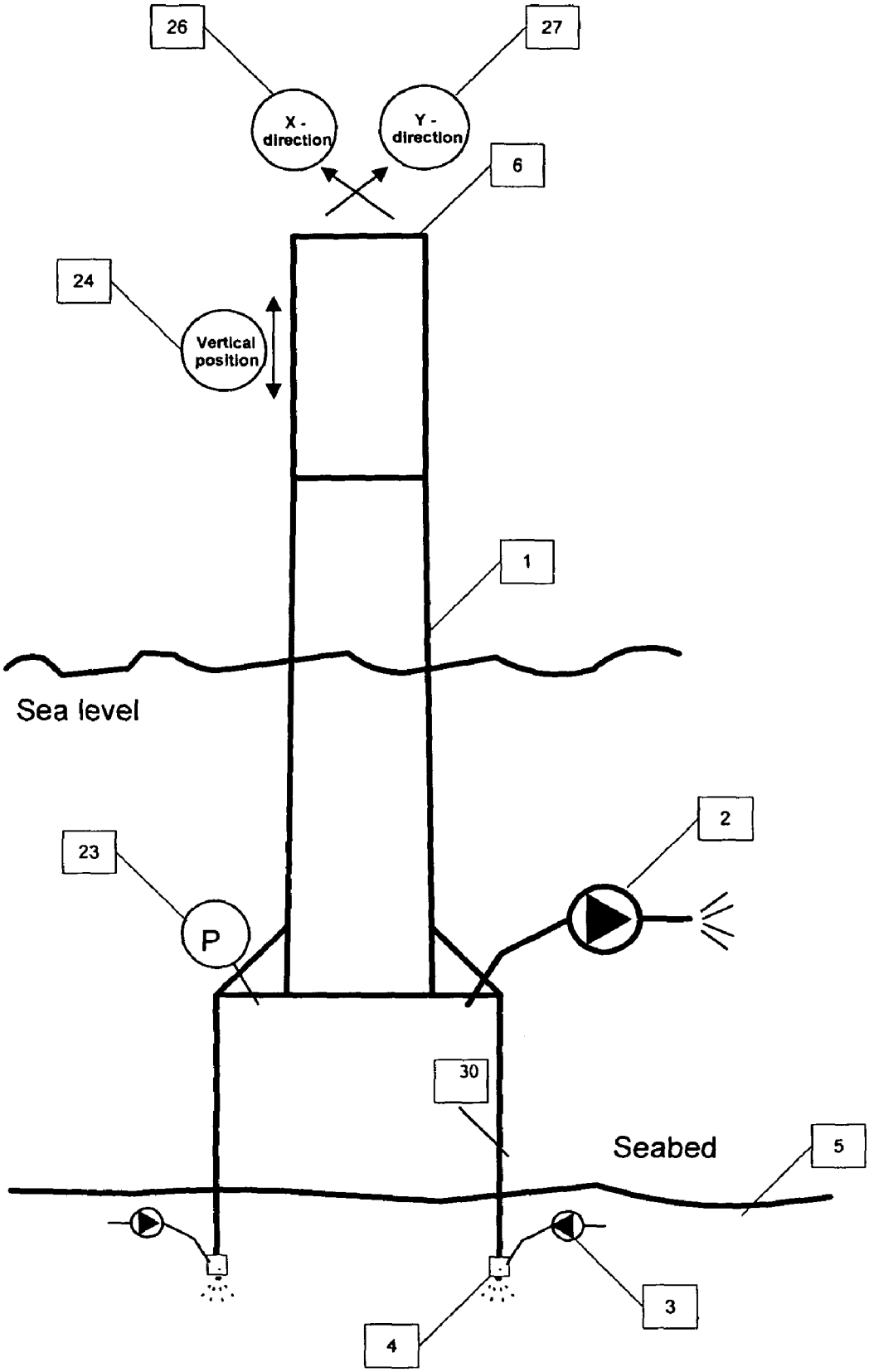
Figure 1. The foundation structure

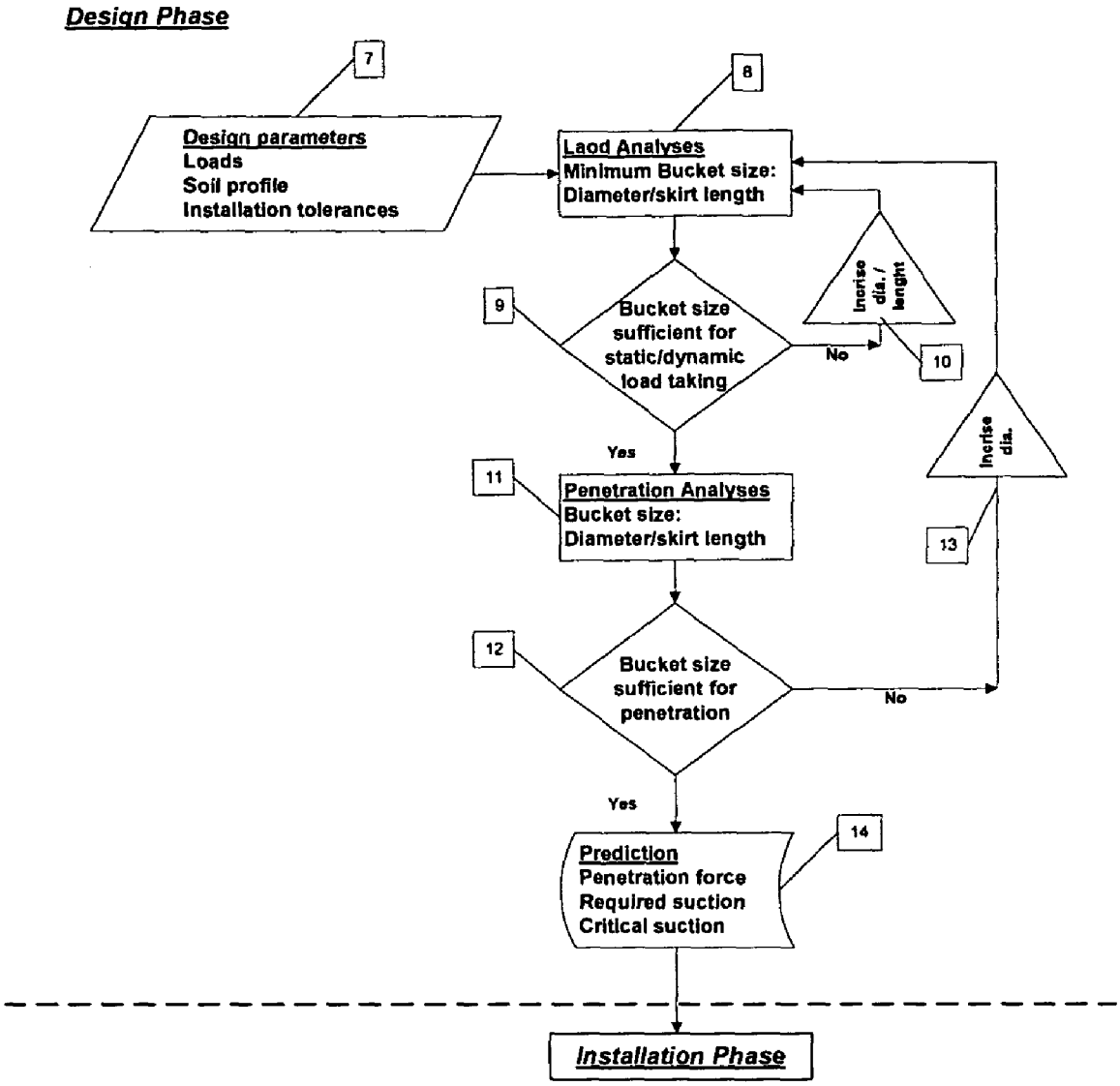
Figure 2. The design Phase

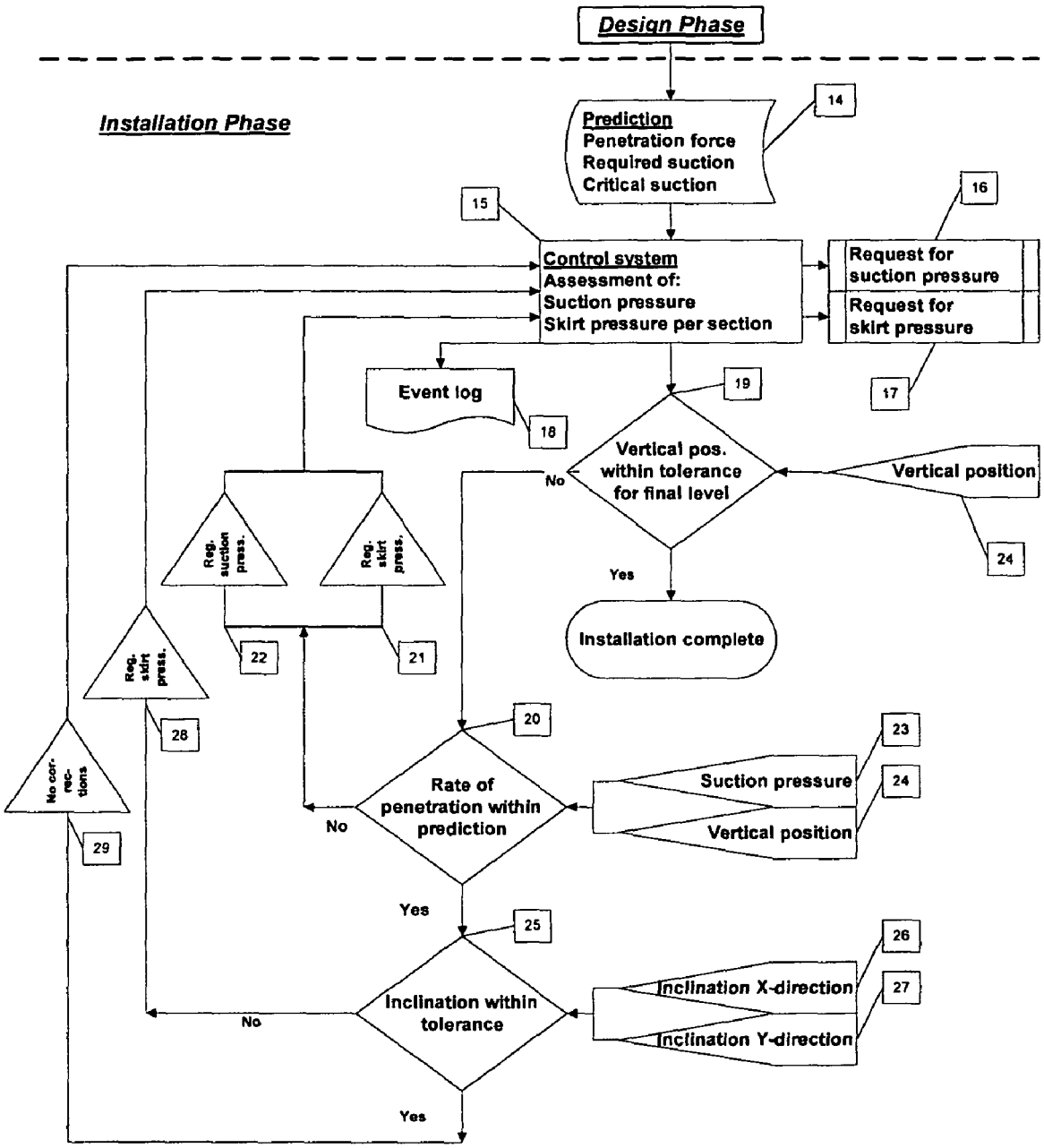
Figure 3. The Installation Phase

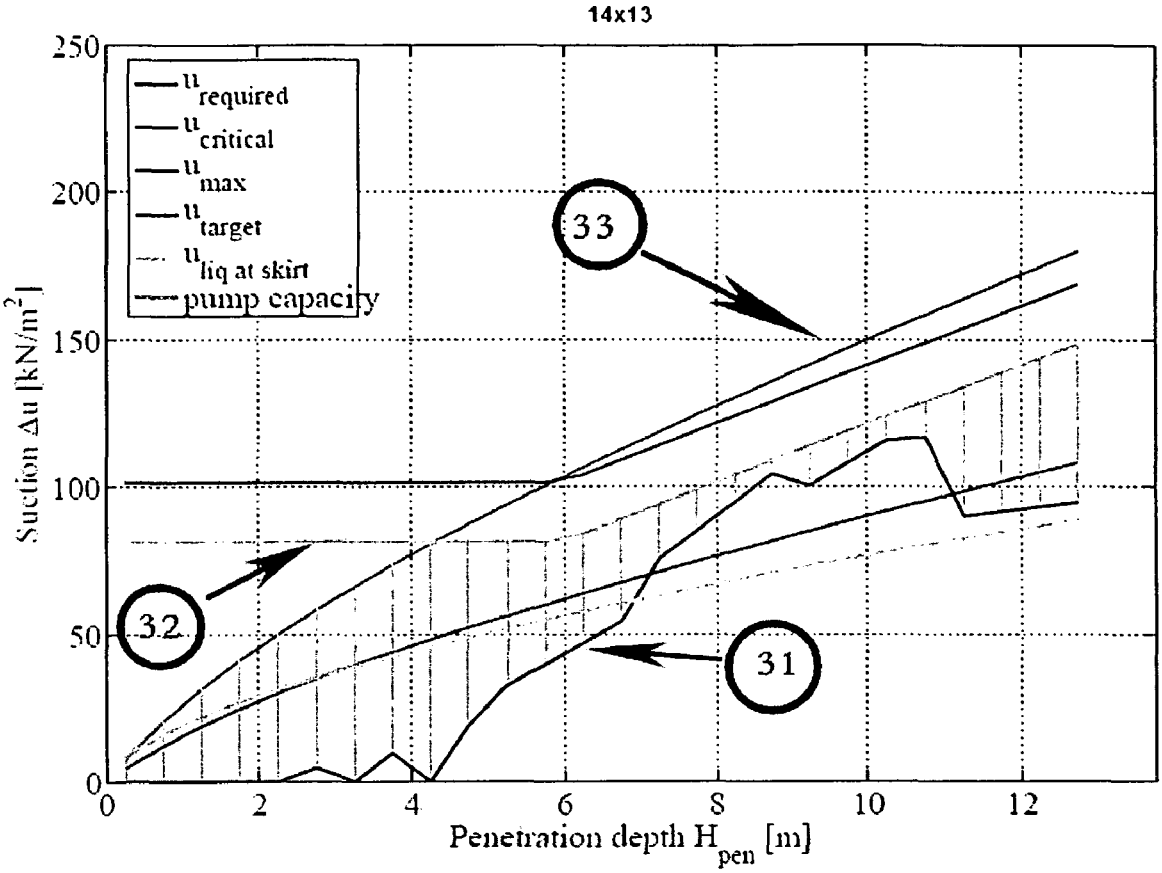
Figure 4. Prediction.

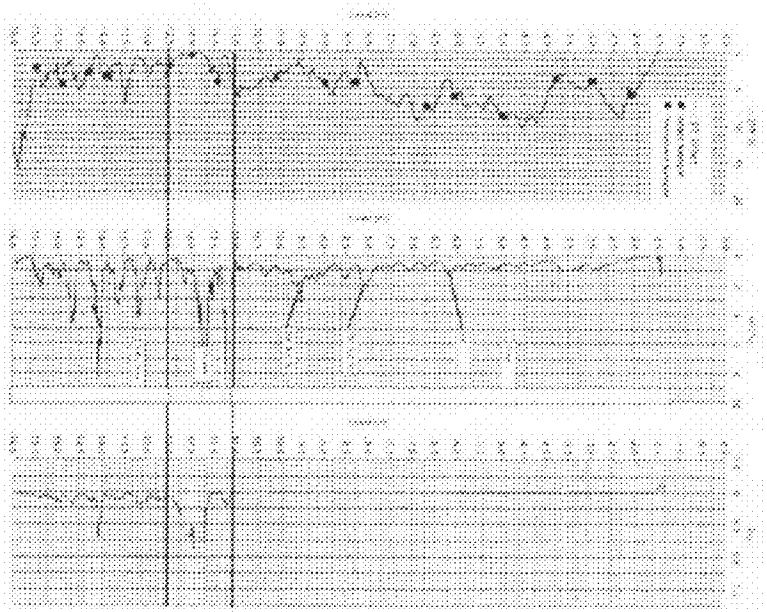
Figure 5. Results of Cone Penetration Test (CPT).
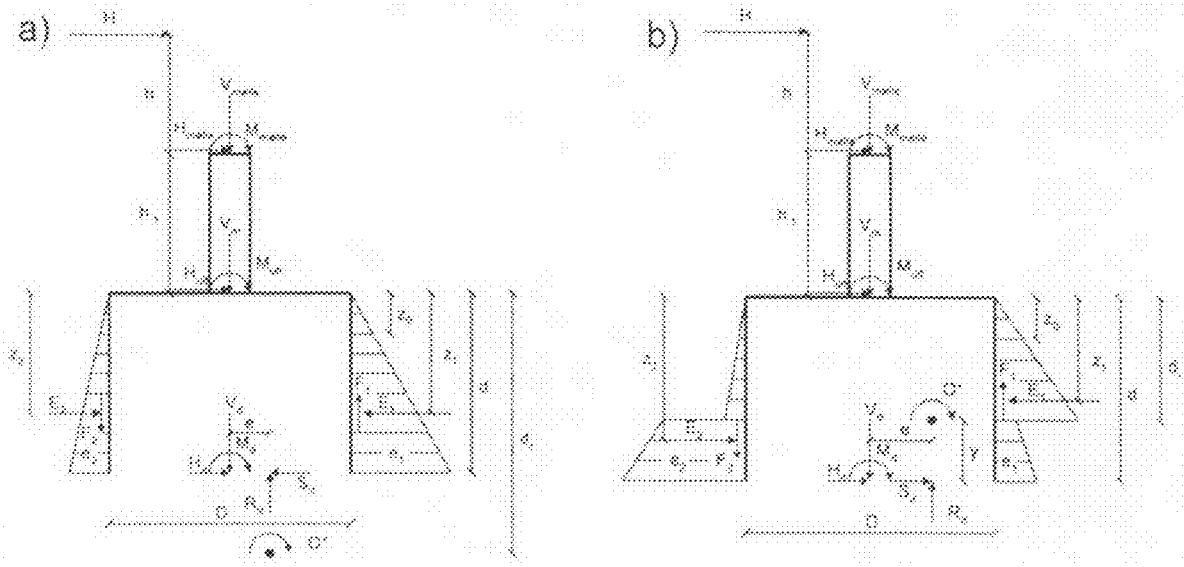
Figure 6. Bucket foundation. Rotation point O. Earth pressure and reaction of the bearing capacity. a) Rotation point below foundation level. b) Rotation point above foundation level.

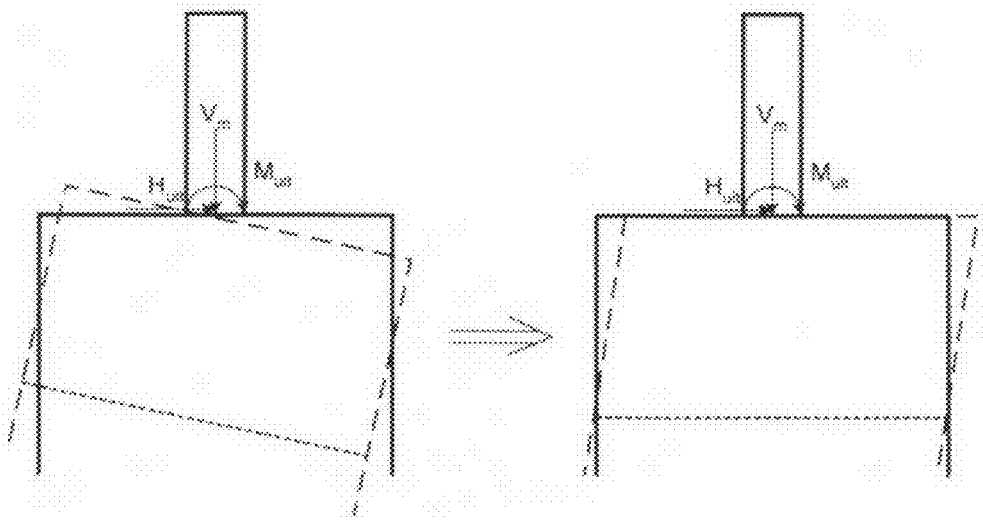
Figure 7. The correct deformation of the bucket approximate by an equivalent deformation
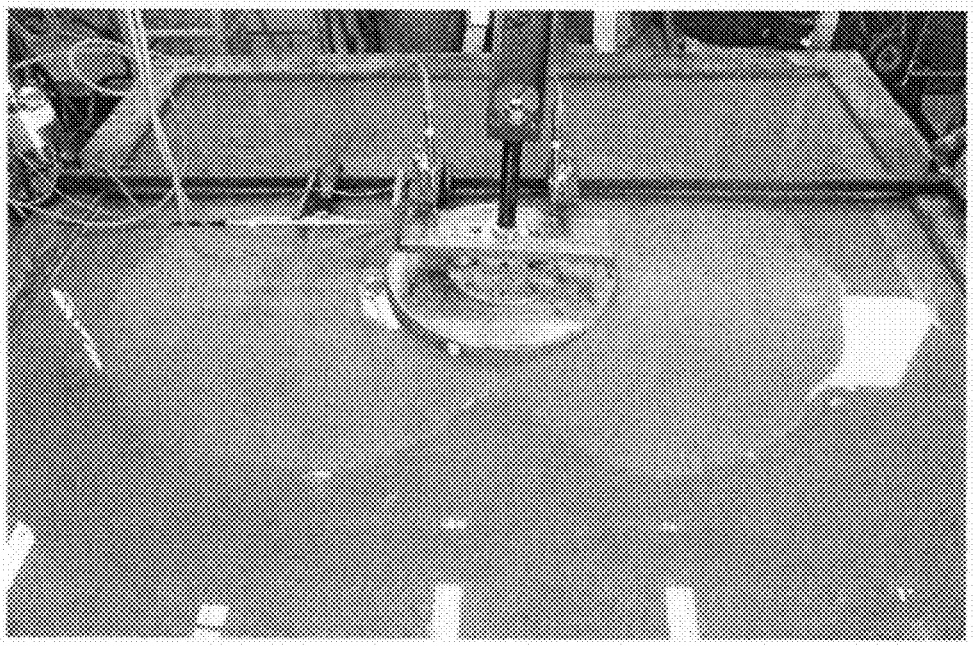
Figure 8. Failure of bucket subjected to combined horizontal and moment loading in laboratory test

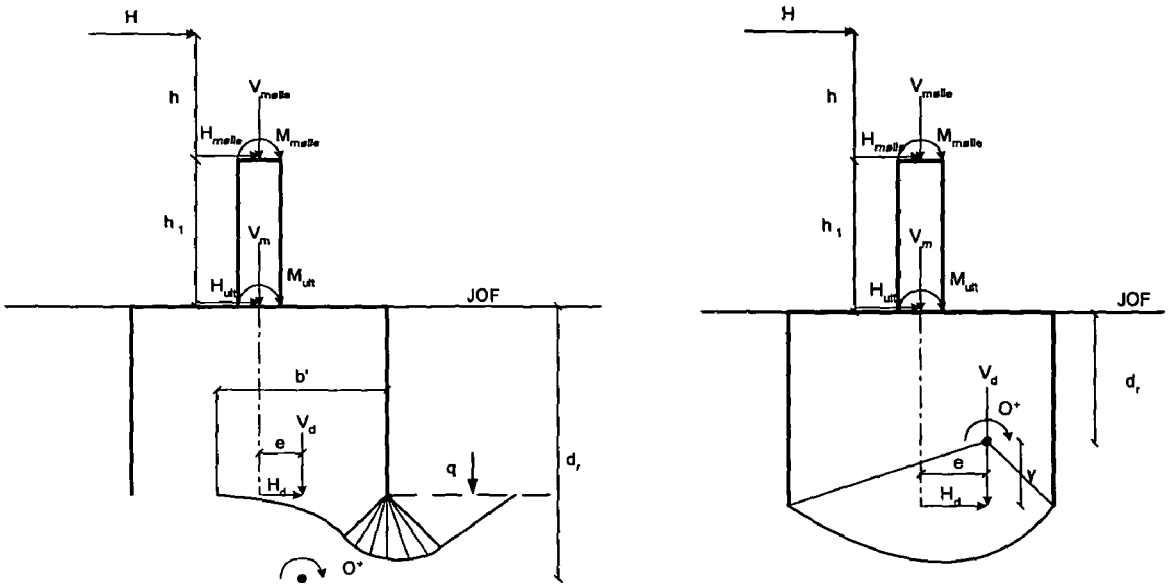
Figure 9. Failure mode a) Bearing capacity failure. b) Line rupture
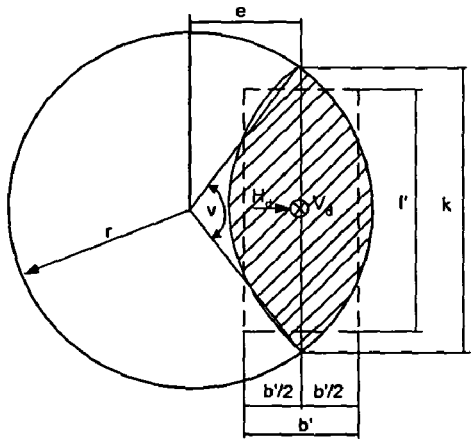
Figure 10. Principle to determine effective area.

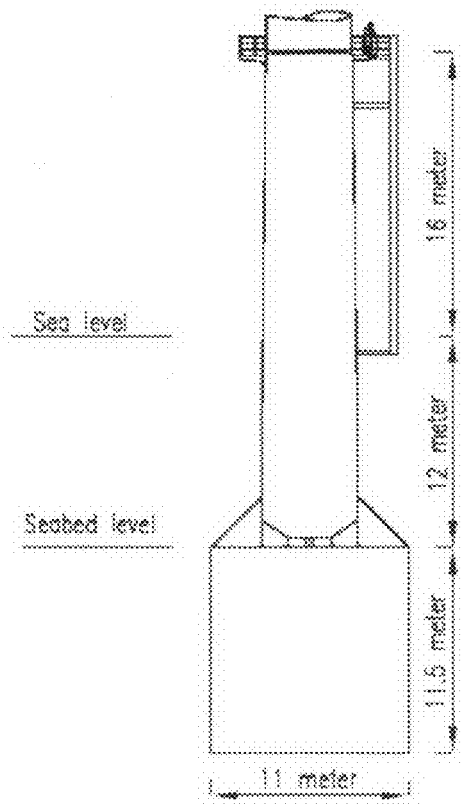
Figure 11. Principle to determine effective area.
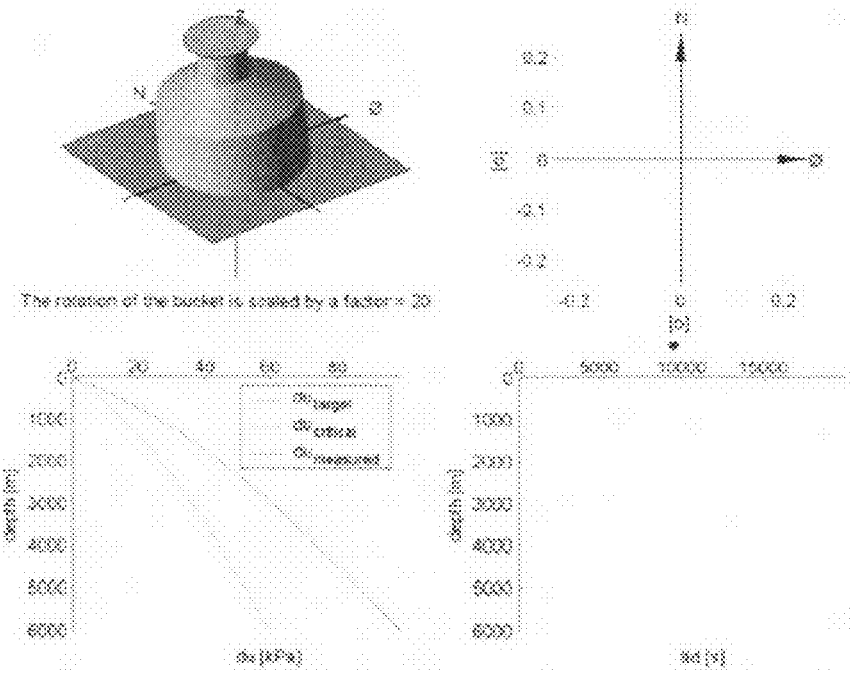
Figure 12. Presentation of operation and control data

FOUNDATION STRUCTURE

This application claims the benefit of Danish Application No. PA 2006 00520 filed Apr. 10, 2006 and PCT/DK2007/000178 filed Apr. 10, 2007, which are hereby incorporated by reference in their entirety.

The invention is related to WO 01/71105 A1: "Method for establishing a foundation in a seabed for an offshore facility and the foundation according to the method".

BRIEF DESCRIPTION

FIG. 1 shows the foundation structure.

FIG. 2 shows the design phase.

FIG. 3 shows the installation phase.

FIG. 4 is a graph showing the prediction.

FIG. 5 shows the result of Cone Penetration Test (CPT).

FIG. 6 shows the Bucket foundation.

FIG. 7 shows the correction deformation of the bucket approximate by an equivalent deformation.

FIG. 8 shows the failure of bucket subject to combined horizontal and moment loading in laboratory test.

FIG. 9 shows failure mode.

FIG. 10 shows a cutout of the principle to determine effective area.

FIG. 11 shows the principle to determine effective area.

FIG. 12 shows the presentation of operation and control data.

Figure 13:
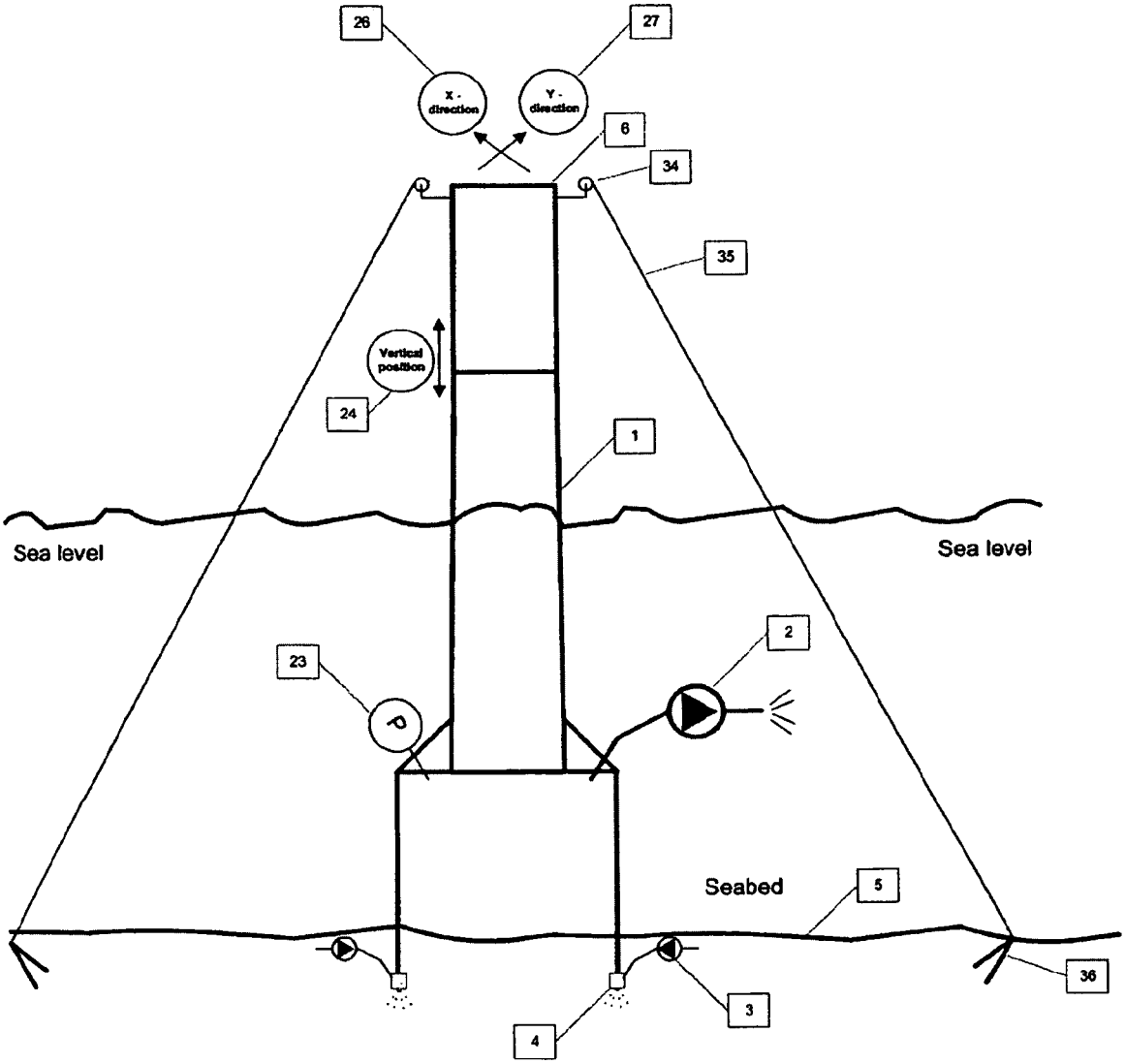
FIG. 13 shows the foundation structure with anchors and cables.

The method of the new invention is to install a foundation structure (1), see FIG. 1, consisting of one, two, three or more skirts, into soils (5) of varying characteristics in a controlled manner (FIG. 1). The method finds use either in a seabed or an onshore location where the soil is beneath ground water level. The skirt can be constructed of sheet metal, concrete or composite material forming an enclosed structure of any open-ended shape used for e.g. bucket foundation, monopiles, suction anchors or soil stabilisation constructions.

The method is based on a design phase (FIG. 2) and an installation phase (FIG. 3) which is the basis for controlling the suction pressure in the enclosure and the pressures and flows along the lower perimeter/rim (edge) (4) of the skirt while penetrating the foundation structure into the soil (5).

The invention makes it possible to control penetration e.g. suction anchors or bucket foundations into the seabed soil even if the soil consists of impermeable layers where it is not possible to establish a flow of water (seepage) around the rim by means of under pressure in the interior of the structure.

The main structure is designed to absorb the different forces and loads which is applied during the installation process and during the operation of the facility, that is to say all the forces and loads the structure is intended and designed to withstand during the operational lifetime of the said facility.

An attachment along the rim of the skirt consists of one or more chambers, typically four, with nozzles where pressure and/or flows of a media, e.g. fluid, air/gas or steam, can be established in a controlled manner through said chambers and nozzles, resulting in the reduction of the shear strength in the soil in the near surroundings of the rim and/or skirt. The pressures and flows can be controlled by means of valves or positive displacements pumps (3) for one, more or all chambers during the placement, i.e. while the structure is lowered into the soil. The invention ensures that the penetration speed and the inclination of the construction are controlled within the design requirements.

The chamber(s) at the rim (4) can be established in the form of a pipe work fitted along the rim with drilled or fitted nozzles pointed in the desired direction(s). The pipe work is connected through risers to a central manifold supplied with the media at a sufficient flow and pressure. Each riser section is fitted with a controlling device (3) regulation flow and pressure.

As an optional feature, see FIG. 13, the main structure can be fitted with a system comprising three or more electrically and/or hydraulically operated winches (34) which are connected to preinstalled anchors (36) by wires (35). When the three winches connected to separate anchors are used, they are arranged with approximately 120° between them, such that they radially extend into different directions. By simply manipulating the winches either alone or in co-operation it is possible to adjust the inclination of the foundation. This system can be used as redundant or excess control measure of the inclination in case of extreme environmental parameters such as high waves or if the rim pressure system is not available for any reason. The operation of the winches can introduce a horizontal force in the opposite direction of an inclination as a corrective action.

The main structure is fitted with transducers for monitoring and logging purposes: The pressure inside the enclosure (23), the vertical position (24) and the inclinations (26) and (27).

The transducers are connected to a central control system (15).

The pipe work on the rim can be of greater, equal or less dimensions than the thickness of the rim.

In the inside of the bucket structure an under pressure may be created. This may be established by activating an evacuation pump creating suction i.e. a lower pressure inside the bucket structure than outside the structure.

The method consists of two stages:

Prediction of the penetration forces, called the design phase (FIG. 2).

Control of the penetration in accordance to the prediction, called the installation phase (FIG. 3).

The method is an integrated approach with regards to the design of the said foundation structures and is based on the calculation and simulation of the precise position of each individual foundation structure with respect to physical in-situ parameters as foundation position and soil characteristics at the particular installation location.

The prediction (14) represented by a diagram, (FIG. 4), showing the calculation of the needed penetration forces (31), the available suction pressure (32) and the maximum allowable suction pressure not causing ground or material failure (33) in accordance to the design code in question.

The calculation is based upon the soil characteristics gained from interpretation of data obtained by a CPT investigating (CPT=cone penetration test), (FIG. 5), the dead weight of the structure, the water depth and the load regime. The input data are evaluated and transformed into the design parameters (7), called the design basis.

The load analysis (8) is an analytical and/or numerical analysis which determines the physical size of the bucket, diameter and skirt length, based on a design methodology using a combination of earth pressure on the skirt and the vertical bearing capacity of the bucket.

If the bucket foundation is regarded as two cramp walls where it is possible to develop stabilizing earth pressures on the front and back side of the foundation, an analytical model for the design of a bucket foundation with the diameter D and a skirt depth of d can be used.

The earth pressure action on the bucket, with a skirt depth of d is assumed to rotate as a solid body around a point of rotation O found in the depth $d_r$, below the soil surface. The mechanism of the earth pressure and reaction of the bearing capacity for the point of rotation is either anticipated to be placed below the foundation level (FIG. 6*a*), or anticipated to be placed above the foundation level (FIG. 6*b*). If the bucket foundation is assumed built of two cramp walls where it is possible to develop a stabilizing earth pressure on the front and back side of the foundation the earth pressures can be calculated with the following approximation. In traditional calculations for vertical walls the point of rotation is found in the plane of the wall, which in this case is not feasible. Thus, the deformation of the bucket is described by two parallel walls with a point of rotation corresponding with the fact that these points are found in the plane of the wall, (FIG. 7) shows the equivalent mode of rupture.

Unit earth pressure may generally be calculated as:

$$e'=\gamma' z K_\gamma + p' K_p + c' K_c \tag{1}$$

Since the bucket is circular with extension D perpendicular to the horizontal force H's and founded in friction soil c=c'=0, the total earth pressure E' is written as:

$$E'=(\sigma_v K_\gamma)D \text{ (kN per m skirt length)} \tag{2}$$

where $\sigma_v'$, is the vertical effective stress in the level in question.

For z≈0 i.e. by the soil surface, $K_\gamma$ corresponds to rupture zones on both sides of a rough wall (plan case) and may be written as:

$$K_q(z\approx 0)=K_{q,pl}=K_\gamma^{pr}-K_\gamma^{ar} \tag{3}$$

applying superscription p and a for passive and active earth pressure and r for rough wall. If Rankine's earth pressure is applied it is not possible to find an exact expression for $K_\gamma$. However, the following equations have been found to describe the exact calculated $K_\gamma$-values with an accuracy which is better than 0.5%, Hansen. B (1978.a):

$$K_\gamma^{pr} = K_p^{pr} + 0{,}007(e^{9\sin\varphi} - 1) \tag{4}$$

$$K_\gamma^{ar} = K_p^{ar} - 0{,}007(1 - e^{-9\sin\varphi})$$

where $$K_p^{pr} = (1 + \sin\varphi)e^{\left(\frac{\pi}{2}+\varphi\right)\tan\varphi} \tag{5}$$

$$K_p^{ar} = (1 - \sin\varphi)e^{-\left(\frac{\pi}{2}-\varphi\right)\tan\varphi}$$

A bucket foundation exposed to a combined moment and horizontal load shows a distinct spatial rupture zones, (FIG. 8). Den spatially influence around the bucket can be interpreted as a active diameter $\overline{D}\geqq D$ of the bucket on which the earth pressure may act from the plane state. In this case the absolute size of the earth pressure may, according to (2) and (3), be written:

$$E'=\sigma_v' K_{q,pl}\overline{D} \tag{6}$$

the active diameter is given by:

$$\overline{D} = D + 0{,}25d\sin\left(\frac{\pi}{4} + \frac{\varphi}{2}\right) \tag{7}$$

The absolute size of the earth pressure is a function of the depth z and assumed to be independent of the position of O. It is possible once and for all to calculate it as the difference between passive and active earth pressure on a rough wall rotating around its lowest point. (FIG. 6*b*) shows that the earth pressures are assumed to change from active to passive in the level of the bucket's rotation point. As a reasonable, permissible static approximation, (6) may be applied to calculate the difference.

$$E_d'=E_1'-E_2' \tag{8}$$

$E_1$ and $E_2$ may with approximation be calculated separately, (3), changing between active and passive earth pressure when passing the level of O. The shear forces $F_1$ and $F_2$ acts stabilizing. If O is located entirely below the surface of the foundation the shear forces may be calculated in the usual manner, since the vertical foundation surfaces are assumed as a rough wall:

$$F_1=E_1 \tan\phi$$

$$-F_2=E_2 \tan\phi \tag{9}$$

However, if the location of O is above the foundation surface, this calculation will be on the unsafe side. A calculation on the safe side corresponding to the calculating of E applying (2)-(6) consists of calculation the following summation:

$$F_d=F_1+F_2=E_d \tan\phi \tag{10}$$

This is directly incorporated into the vertical equilibrium equation. In the moment equation, around the point on the centre line of the foundation it is incorporated with moment lever D/2.

When calculating the bearing capacity of the bucket the first calculation must deal with the different rotation points located on the symmetric line of the bucket. The earth pressures as well as the external forces ($V_m$, $H_{ult}$, $M_{ult}$) must be converted to 3 resultant components of forces at the bottom of the bucket, (FIG. 6). This is done by requiring vertical, horizontal, and moment equilibrium.

Horizontal:

$$H_d=H_{ult}-E_d \tag{11}$$

Vertical:

$$V_d=V_m-F_d \tag{12}$$

where $V_m=V_{molle}+(V_{fu}^j+V_{fu}^s)^R$ $V_{molle}$ is the weight of the wind turbine $(V_{fu}^j+V_{fu}^s)^R$ is the bucket's weight of iron and soil reduced for buoyancy Moment:

$$M_d = M_{ult} + H_{ult}d + E_2(d - z_2) - E_1(d - z_1) - F_d\frac{D}{2} \tag{13}$$

Concerning the bearing capacity at the bottom of the foundation it should be noted that it is characterized by a large eccentricities e, and a large q-part described by q/γb'.

The permissible load; $H_d$ is obtained by the earth pressure $E_d$ and the shear force $S_d$ which in this case may be calculated from:

$$S_d=V_d' \tan\phi_d' \tag{14}$$

To ensure against rupture due to sliding the following inequality must be complied with:

$$H_d\leqq S_d+E_d \tag{15}$$

Furthermore it must be demonstrated that there is sufficient safety against bearing capacity rupture:

$$V_d \leqq R_d \tag{16}$$

In a normal bearing capacity rupture as shown in (FIG. 9*a*), the general bearing capacity equation:

$$\frac{R'_d}{A'} = \frac{1}{2}\gamma' b' N_\gamma i_\gamma + q' N_q i_q \tag{17}$$

may be used assuming that b'/l' is so close to zero, that all shape factors can be set equal to 1. No depth factor is used since $E_1$ and $F_1$ both are included when considering the equilibrium of the foundation. This rupture corresponds to a point of rotation O below skirt level, i.e. $E_1$ is a complete passive earth pressure and $E_2$ a complete active earth pressure. The dimensionless factors N and i are determined from the equations below, by using the permissible plane friction angle $\phi_d$.

$$N_\gamma = \frac{1}{4}((N_q - 1)\cos\varphi_d)^{\frac{3}{2}} \tag{18}$$

$$N_q = e^{\pi\tan\varphi_d}\left(\frac{1+\sin\varphi_d}{1-\sin\varphi_d}\right)$$

$$i_\gamma = i_q^2 \tag{19}$$

$$i_q = \left(1 - \frac{H_d}{V_d + A'\cot\varphi_d}\right)^2$$

If e becomes sufficiently large, an alternative rupture is found which may be much more dangerous, (FIG. 9*b*). This rupture has proven to be possible if e≧e', where $$\frac{e'}{D} \approx 0,45\sin(1,5\varphi_d) \tag{20}$$

The corresponding bearing capacity may be written:

$$\frac{R'_d}{A'} = \frac{1}{2}\gamma' b' N_\gamma^e i_\gamma^e \tag{21}$$

where:

$$N_\gamma^e \approx 2N_\gamma \tag{22}$$

$$i_\gamma^e \approx 1 + 3\frac{H_d}{V_d}$$

It is noted that the horizontal force $H_d$, pointing towards the edge of the skirt now acts stabilizing. On the other hand there is no q-led, because the line failure terminates under the bucket.

The effective area A' used in the bearing capacity equation is the area in the skirt dept d and is calculated as twice the area of the segment of a circle, which passes through $V_d$. Afterwards A' is transformed to a rectangle with the identical area (FIG. 10):

$$e = \frac{M_d}{V_d} \tag{23}$$

-continued $$A' = r^2\left(v\frac{\pi}{180} - \sin v\right) = b'l'$$

$$v = 2\arccos\left(\frac{e}{r}\right)$$

$$b' \approx \sqrt{\tan\left(\frac{v}{4}\right)A'} \approx 1,7(r-e)$$

$$l' = A'/b'$$

In the method of calculating the moment capacity of the bucket, a precise calculation of earth pressure and bearing capacity for the bucket demands that the kinematical conditions have been complied. The point of rotation O which is the centre of the line failure in (FIG. 9*b*) must also be the point of rotation used in the earth pressure calculation, (FIG. 6*b*). However, a precise calculation on these conditions is extremely complicated. For the determination of this moment capacity for a bucket with fixed dimensions D, d and $V_m$ the following statically permissible method of approximation, is in accordance to/Hansen. B (1978.*b*)/and is on the safe side. The largest moment capacity is obtained if Ed is utilized to the full depth (identical stabilizing force, but larger moment):

1. O's level (Pressure jump) is chosen so that $H_d$=0 at the bottom of the foundation
2. It is controlled that the bearing capacity of the line failure is the most critical.
3. If not 0 must be raised by increasing $H_{ult}$.
4. $M_{ult}=H_{ult}(h+h_1)$
5. The moment capacity of the bucket has been reached when $H_{ult}$ has been increased so much that $V_d=R_d$, where $R_d$ has been determined by the equation (21).
6. As control the following calculation has been made:

$$H_{ult} = S_d + E_d \tag{24}$$

$$M_{ult} = R_d e + F_d\frac{D}{2} + E_1(d - z_1) - H_{ult}d - E_2(d - z_2) \tag{25}$$

With small loadings the resulting load at the lower edge of the foundation will adopt negative values. This is caused by the fact that the passive earth pressure exceeds the external load. As the passive earth pressure cannot act as a driving force, the following requirements to the resulting loads as well as eccentricity are introduced:

$$H_d < H_{ult} \tag{26}$$

$$V_d > 0$$

$$0 < e < \frac{D}{2}$$

The input data for the load analyses is the design parameters (7). The analysis process is performed using formulas and methods based on series of tests on scale buckets varying from Ø100 mm to Ø2000 mm in diameter. The ability of the structure/soil interaction to handle the load regime, e.g. static load and dynamic load, is evaluated. If the safety level stipulated in the design code in question, is not within the given limits, the diameter and/or the length of the bucket respective skirt are increased (10), and the load analyses is repeated.

If the safety level is within the limits given in the design codes, the penetration analysis (11) is performed with the calculated bucket size. The calculation follows the design procedure of a traditional, embedded gravity foundation. The gravity weight of the foundation is primarily obtained from the soil volume enclosed by the pile, yielding also an effective foundation depth at the skirt tip level. The moment capacity of the foundation is obtained by a traditional, eccentric bearing pressure combined with the development of resisting earth pressures along the height of the skirt. Hence, the design may be carried out using a design model that combines the well-known bearing capacity formula with equally well-known earth pressure theories. The foundation is designed so that the point of rotation is above the foundation level, i.e. in the soil surrounded by the skirt and the bearing capacity. Rupture occurs as a line failure developed under the foundation.

The ability to penetrate the foundation into the soil is evaluated (12). If the bucket can not be penetrated within the parameters given in the prediction, (FIG. 4), the bucket diameter is increased (13) and the load analyses (8) are repeated. This design stage is called conceptual design.

The prediction is presented in a graphic diagram, (FIG. 4), to be used by the detailed design for the construction of the foundation structure and for the installation process. The prediction is presented as an operation guideline used by the operators or is feed directly to a computerized control system as data input.

The prediction includes parameters for the penetration force, the critical suction pressure which will cause soil failure, critical suction pressure which will cause buckling of the foundation structure, available suction pressure due to limitations in the pump system as a function of the penetration depth.

The installation of the said foundation structures is a controlled operation of the penetration process. The operation of the control system (15) is performed either manually, semi automatically or fully automatically based upon interpretation of the above-mentioned data (14). In order to automate the process partly or fully investments must be made in suitable equipment, but any step in the process may be carried out by manual means. The control is performed based on readings of the actual penetration depth and inclination of the structure by high accuracy instruments.

The control action can be introduced into the soil (5) in different modes:

- Constant flow of media in one or more chambers (4).
- Constant pressure established by a media in one or more chambers (4).
- Variations of flow or pressure established by a media in one or more chambers (4).
- Pulsating flow/pressure established by a media in one or more chambers (4).

The mode is selected in accordance with the prediction, depending of the properties of the soil e.g. grain size, grain distribution, permeability.

The soils reaction to the initiated control actions is either reduction of the shear strengths at the rim of the skirt (30) or reduction of the skin friction on the skirt surface or a combination of both.

The control system (15) consists of elements illustrated in the flow diagram (FIG. 3) and example of the user interface regarding actual readings (FIG. 12).

Input elements are the measuring devices for the vertical position (24), the inclination in X-direction (26), the inclination in Y-direction (27) and the pressure inside the bucket, e.g. suction pressure (23).

Output elements are data to regulate the suction pressure (16), data to regulate the individual pressure/flow (17) in one or more chambers at the skirt rim (4) and data for the event recording (18) for the verification of the installation process.

An optional output element is data to operate the optional winches (34), see FIG. 13. The alternative or additional system comprising winches is explained above.

Different control routines are implemented in the control system to initiate the actions ensuring the installation process to be within the predicted tolerances. As a minimum three routines are needed, 1) verification of vertical position (19), 2) verification of penetration velocity/suction pressure (20) and 3) verification of inclination (25). The sequence of the control routines can be arranged to suit the actual installations situation.

The routine for vertical position (19) measures the vertical position (24) of the structure with reference to the seabed, if the position is within the tolerances of the finial level; say +/−200 mm, the installation procedure is finalized.

The routine for verification of penetration velocity/suction pressure (20) measures the vertical position (24) with a sampling rate sufficient to calculate the penetration velocity. The installation process is started in a mode with no pressure/flow in the chambers at the rim (4). If the rate of penetration is below the minimum level, say <0.5 m/h, the suction pressure is increased (22). The suction pressure is measured (23); the suction pressure must be kept below the safety level for soil failure, say 60% of the critical suction pressure calculated in the prediction. If the suction pressure is at the maximum level and the penetration velocity is not increased, the control mode is changed (21) to constant or pulsating pressure/flow in the entire chambers (4).

The verification of inclination (25) measures the inclination in the X-direction (26) and the Y-direction. If the inclination is not within the tolerances stated in the design basis, corrective action is initiated (28). If running in the control mode with no pressure/flow in the chambers (4), the control device (3) in the sector of the same direction as the desired correction is activated. If running in the control mode with constant/pulsation pressure/flow in the chambers (4), the control device (3) in the opposite sector of the direction as the desired correction is deactivated. An optional control measure can be initiated by operating the winch system (34).

ADVANTAGES

The advantages of using the said methodology is three fold compared the normal used methods for placing skirted foundations/anchors:

Penetration to a greater depth using less penetration force for a given physical dimension of the embodiment without disturbing the overall soil conditions and strength is achieved.

Penetration of this type of foundation structures in permeable layers beneath layers of impermeable material e.g. silt/soft clay is possible.

The ability to control the inclination of the foundation structure during the penetration process is assured.

EXAMPLE OF USE

The bucket foundation can be used for e.g. offshore based wind farms where the wind turbines or metrology masts are mounted on a foundation structure provided in the seabed. The application of the bucket foundation can be facilitated in a variety of site locations and load regimes in the range as follows:

| | |
|---|---|
| Seabed soils: | Loose to very dense sand and/or soft to very stiff clays. |

-continued

| | | |
|---|---|---|
| Water depth: | 0-50 | m |
| Load regime: Vertical loads: | 500-20.000 | kN |
| Horizontal loads: | 100-2.000 | kN |
| Overturning moment: | 10.000-600.000 | kNm |

An example of a typical bucket foundation for offshore wind turbine installation is shown in (FIG. 11). The overturning moment at seabed level is 160.000 kNm, vertical load is 4.500 kN and horizontal load is 1000 kN.

The seabed consists of medium dense sand and medium stiff clay.

The foundation structure consists of a bucket with a diameter of 11 m and a skirt length of 11.5 m and a total height over seabed of 28 m. The overall tonnage of the foundation structure is approximately 270 tons. The thickness of the steel sheet material is 15-60 mm in the various part of the structure.

The skirt is penetrated into the seabed with a velocity of 1-2 m/h giving an overall installation time for the foundation of 18-24 hours exclusive of work for scour protection if needed.

The invention claimed is:

1. Method of installing a bucket foundation structure comprising one, two, three or more skirts, into soils of varying characteristics in a controlled manner, where the method comprises two stages: a first stage being a design phase and the second stage being an installation phase, such that in the first stage, design parameters are determined relating to the loads on the finished foundation structure; soil profile on the location of installation; allowable installation tolerances, which parameters are used to estimate the minimum diameter and length of the skirts of the bucket, which bucket size is used to simulate load situations and penetration into foundation soil, in order to predict necessary penetration force, required suction inside the bucket and critical suction pressures, which penetration force, required suction, and critical suction pressures are used as input for a control system in the second stage, in which second stage the parameters determined in the first stage are used in order to control the installation of the bucket; and further that sensors provided in the installation equipment, such as pumps, conduits and on the structure, feeds input to the control system, where the input from the sensors are compared to the parameters derived from the first stage, and that the control system activates and/or deactivates different means arranged in and around the bucket foundation structure for creating the penetration force needed.

2. Method according to claim 1 wherein the bucket foundation structure has one, two, three or more skirts, and that the skirts define a lower rim of the bucket structure, as seen in the use situation, and that further a plurality of apertures or nozzles interconnected with appropriate conduits are distributed along the lower rim of the bucket structure, such that a flow and/or jets of media, such as a fluid, gas, air, steam may issue from the apertures or nozzles.

3. Method according to claim 2, wherein the apertures and/or nozzles are arranged in attachments in the shape of one or more chambers provided along at least part of the lower rim of the bucket structure.

4. Method according to claim 1, wherein the pressures and media flows are controlled according to input from the first stage by controlled manipulation of valves and pumps, for example positive displacement pumps, in accordance with the control parameters loaded into the control system.

5. Method according to claim 1, wherein the control system during the second stage controls the penetration of the structure by activating control actions such as creating one or more of the following:

constant flow of media in one or more chambers or conduits;

constant pressure established by a media in one or more chambers or conduits;

variations of flow or pressure established by a media in one or more chambers;

pulsating flow and/or pressure established by a media in one or more chambers or conduits.

6. Method according to claim 1, wherein the sensors are selected among the following: transducers, inclinometers, accelerometers, pressure sensors.

7. Method according to claim 1, wherein the second stage is either manually operated, semi-automatically or fully automatically operated by means of computers.

8. Method according to claim 1, wherein a system comprising three or more winches are arranged on an upper part of the foundation, where a wire is arranged between the winches and pre-installed anchors, where said anchors are arranged substantially equidistant radially around the foundation structure, and where the winches may be activated in order to reel in or reel out wire in response to data from the control system, whereby the system provides additional guidance control for the placing of the foundation structure in the second stage.

* * * * *